United States Patent [19]

Kawasumi

[11] 4,450,188

[45] May 22, 1984

[54] PROCESS FOR THE PREPARATION OF PRECIOUS METAL-COATED PARTICLES

[76] Inventor: Shinroku Kawasumi, 5-7-17, Inamuragasaki, Kamakura-shi, Kanagawa Prefecture, Japan

[21] Appl. No.: 251,746

[22] Filed: Apr. 7, 1981

[30] Foreign Application Priority Data

Apr. 18, 1980 [JP] Japan ..... 55-51516
Aug. 26, 1980 [JP] Japan ..... 55-116482

[51] Int. Cl.[3] ..... B05D 7/14; B05D 5/12; H01B 1/02

[52] U.S. Cl. ..... 427/217; 252/513; 252/514; 427/96; 427/125; 427/215; 427/216

[58] Field of Search ..... 427/212, 215, 216, 217, 427/96, 125; 252/513, 514, 520; 428/403, 404, 406

[56] References Cited

U.S. PATENT DOCUMENTS 2,853,401 9/1958 Mackiw et al. ..... 427/217
3,940,510 2/1976 Höhne et al. ..... 427/217
4,130,506 12/1978 Collier et al. ..... 427/217 X
4,242,376 12/1980 Kawasumi et al. ..... 427/216
4,287,253 9/1981 Leech ..... 427/217 X

*Primary Examiner*—Thurman K. Page
*Attorney, Agent, or Firm*—Frishauf, Holtz, Goodman & Woodward

[57] ABSTRACT

A process for the preparation of precious metal-coated particles which comprises adding a reducing agent to an aqueous suspension containing:

(A) homogeneously suspended core material particles;
(B) homogeneously suspended precious metal salt particles; and
(C) dissolved precious metal ions in an aqueous acidic medium having little dissolving capacity for the core material to produce precious metal-coated particles through gelling state, and recovering the produced precious metal-coated particles.

The invention also provides alternate processes (1) wherein the precious metal salt is in a solution and (2) wherein the components are in a chelated gelling mixture which also uses an alkali agent, which also produce the precious metal-coated particles via the gelling state.

8 Claims, No Drawings

PROCESS FOR THE PREPARATION OF PRECIOUS METAL-COATED PARTICLES

This invention relates to a process for the preparation of precious metal-coated particles. More particularly, this invention relates to a process for preparing particles each of which comprises a core material portion coated substantially completely with a precious metal layer.

Particles comprising a core material portion made of inorganic material such as metal, metal oxide, ceramics and glass, and a precious metal layer coated on the core portion are employed or under study in various arts. For instance, particles in which precious metal such as gold or silver is coated on a core portion made of non-precious metal such as copper or nickel are under study for use as an electroconductive paste (namely, electroconductive coating material), a contactor and so forth used in electric circuits. Heretofore, electroconductive materials such as the electroconductive paste for use in electric circuits were generally made of pure precious metal such as gold, silver platinum or palladium with a small amount of additives. The additives in the electroconductive paste are incorporated only for facilitating deposition of the paste on the circuits and selected from materials giving substantially no disturbance to the electroconductivity. Since the use of precious metal is very expensive and the price of the precious metal is rising quickly, trials for replacing the precious metal with a mixture of the precious metal and non-precious metals such as copper and nickel have been carried out in the field of electroconductive materials such as on electroconductive paste. However since such mixtures show electroconductivity far lower than the pure precious metal, these trials have been discontinued. In place of these mixtures, particles of non-precious metal coated with precious metal have been studied as substitutes for the pure precious metal component as seen, for instance, in Japanese Patent Publications No. 46(1971)-40593 and No. 49(1974)-21874: the former discloses the use of particles having a copper coated with silver metal, in place of pure silver metal, and the latter discloses the use of particles having a copper-bismuth coated with silver metal in the art of electroconductive pastes.

In these publications, there are given a variety of methods for coating the core material particle with the precious metal, such as the electroplating, vacuum deposition, and chemical plating. Chemical plating can be generally carried out in a simple vessel and with a simple procedure, and therefore, the chemical plating process is very advantageous for the industrial application. As the chemical plating process, there is well known a process involving a reaction with a weak reducing agent such as sucrose, namely, the silver mirror reaction. In the aforementioned publications, the chemical plating process involving the silver mirror reaction is concretely disclosed. However, according to experiments of the present inventor, the silver mirror reaction is considered to be practically unemployable for preparing the precious metal-coated particles of high quality for use as the electroconductive material. The particles prepared by the use of the silver mirror reaction neither show satisfactory electroconductivity nor appropriate adhesive property to a soft solder.

The poor electroconductivity and adhesive property to the soft solder is considered to originate from contamination of the surface layer of the particle with the core material. The reaction solution for the silver mirror reaction involves nitric acid, and such core metals as nickel and copper are in part dissolved in the aqueous nitric acid. Accordingly, when the precious metal layer is coated on the core metal particle, the dissolved core metal material is introduced into the coating layer to contaminate the precious metal layer. The contamination of such core materials into the precious metal coating layer causes a lessening of the electroconductivity and adhesive property to the soft solder.

In addition to the above-described drawbacks, there is another drawback in the conventional chemical plating methods such as the method involving the silver mirror reaction, a method involving immersion of core material particle in a precious metal-containing aqueous solution, etc.; that is, the conventional chemical plating method hardly gives thick and uniform precious metal coating layer on the core metal particles.

The present invention provides a process for the preparation of precious metal-coated particles in which the precious metal coating layer has substantially no contamination with the core material employed.

The particles prepared according to the process of the present invention substantially consists of the core material portion and the precious metal coating layer with substantially no contamination with the core material. For this reason, the so prepared particles give satisfactory electroconductivity and adhesion to the soft solder when employed as the electroconductive material for electric circuits.

The process of the invention includes a process comprises adding a reducing agent to an aqueous suspension containing:

(A) homogeneously suspended core material particles;

(B) homogeneously suspended precious metal salt particles; and (C) dissolved precious metal ions in an aqueous acidic medium having little dissolving capacity for the core material to produce precious metal-coated particles through gelling state, and recovering the produced precious metal-coated particles.

The above-described process is referred to hereinafter as "precious metal salt suspension process". The characteristic feature of the precious metal salt suspension process lies in that the precious metal is supplied with both forms of dissolved ions and suspended particles. Another characteristic feature lies in that the reduction reaction for forming the precious metal coating layer is carried out through gelling state.

Examples of the precious metals employed in the process of the invention include silver, gold, platinum and palladium. There is no specific limitation on the salt form of the precious metal, so far as the salt is soluble in the aqueous acidic medium employed for preparing the suspension to an extent, at least, enabling to form the suspended salt phase and the dissolved ionic phase in the medium. Examples of the salt forms include nitrate, hydrochloride and cyanide. There is likewise no specific limitation on the sizes of the precious metal salt particles. In general, the mean particle size is almost similar to or less than the mean size of the core material particles.

Examples of the core materials include non-precious metals such as transition metals, e.g., copper, nickel, cobalt and iron, and their alloys, oxides of metallic or non-metallic elements such as aluminum oxide, zirconium oxide, titanium dioxide, silica, and water insoluble metal salts such as barium titanate. Particularly preferred core materials are copper and nickel. The mean diameter of the core material particles is generally less than 30μ and preferably less than 10μ.

The aqueous acidic medium to be employed in the above-described process has a certain degree of dissolving capacity for the precious metal salt to be employed and should have little dissolving capacity for the core material to be employed in the reaction. Accordingly, an aqueous inorganic acid consisting of a strong inorganic acid such as hydrochloric acid, sulfuric acid or nitric acid and water is generally employed. A water-miscible organic solvent such as methyl alcohol, ethyl alcohol, acetone, tetrahydrofuran, or ethyl ether can be included in the inorganic acid solution. The inorganic acid is selected depending upon nature of the core material. For instance, since nitric acid dissolves copper and nickel, nitric acid is not appropriately employed when the core material is selected from copper and nickel. Concentrated hydrochloric acid is generally employed when copper or nickel is used as the core material.

There is no specific limitation on the reducing agent to be employed in the process, so far as it can reduce both of the precious metal salt and the precious metal ion included in the reaction system. However, since a reducing agent containing a metallic element may possibly be carried into the precious metal layer to deteriorate the coating layer quality, hydrogen peroxide and organic reducing agents such as hydrazine are preferred. Particularly preferred is hydrazine. The reducing agent is added to the suspension in an amount enough to reduce the precious metal salts and ions to convert to the metallic form.

The ratio of the amount of the core material against the total amount of the precious metal including both of those present in the suspended salt form and those present in the ionic form preferably ranges from 1/9 to 7/3, more preferably 1/9–4/6. The ratio of the amount of the core material against the amount of the precious metal contained in the precious metal-coated particle is substantially similar to the ratio of those in the reaction system, and generally ranges from 1/9 to 7/3.

Examples of the preferred combinations of the core material, the precious metal (precious metal salt), the inorganic acid to be included in the aqueous acidic medium of the suspension, and the reducing agent include:

(1) copper-silver (silver nitrate or silver chloride)-hydrochloric acid-hydrazine; and (2) nickel-silver (same)-hydrochloric acid-hydrazine.

The precious metal salt suspension process will be described hereinbelow with reference to the above-mentioned combination (1).

A copper powder is added to conc. hydrochloric acid to prepare a suspension [(I) suspension]. Most of commercially available copper powders are coated with on oxide film, and this oxide film works negatively in providing a satisfactory adhesion between the copper core and the silver coating layer. For this reason, the commercially supplied copper powder is preferably processed to remove the oxide film in advance of carrying out the coating procedures of the invention. The removal of the oxide film can be carried out by, for instance, immersing the copper powder into dilute hydrochloric acid or an aqueous solution of a reducing agent such as hydrazine or hydrogen peroxide.

Separately, a silver salt such as silver chloride or silver nitrate in microgranular form is suspended in conc. hydrochloric acid. The suspension is then stirred for a while to dissolve a portion of the silver salt in the hydrochloric acid. The resulting suspension is referred to as (II) suspension.

The (II) suspension is added, at once or portionwise, to the (I) suspension under stirring. To the so obtained suspension mixture is further added under stirring hydrazine in an amount enough to reduce all of the silver salt contained in the suspension mixture. The hydrazine is preferably added by two portions. At the same time of the addition of hydrazine or within a while after the addition, the suspension mixture turns into gelling state. Vigorous stirring is applied to the gelling suspension, and within a while the gelling state is broken to convert the mixture again to the simple suspension. The coating of the copper powder with metallic silver layer is completed at the time when the gelling state is broken. The so obtained silver coating layer consists of pure silver metal with substantially no contamination with copper.

This invention further provides another process for the preparation of precious metal-coated particles which comprises:

adding a portion of a reducing agent to an aqueous suspension containing:

(A) homogeneously suspended core material particles; and (B) dissolved precious metal ions in an aqueous acidic medium having little dissolving capacity for the core material to convert the aqueous suspension to a gelling suspension;

adding a remaining portion of the reducing agent to the gelling suspension; and recovering the produced precious metal-coated particles.

The above-described process is referred to hereinafter as "precious metal solution process". The characteristic feature of the precious metal solution process lies in that the coating reaction is necessarily carried out in a gelling suspension.

Examples of the core material, the precious metal (precious metal salt), the aqueous acidic medium, and the reducing agent are the same as those described for the precious metal suspension process. The ratio between the core material and the precious metal is also the same as those described for the precious metal suspension process (referred to hereinafter as Suspension Process).

The precious metal solution process will be described hereinbelow with reference to a preferred combination of copper-gold ($HAuCl_4$)-hydrochloric acid-hydrazine.

The (I) suspension of copper powder is prepared in the same manner as in Suspension Process.

Separately, a gold salt such as $HAuCl_4$ is introduced in hydrochloric acid to make its solution [(II) solution]. The (I) suspension and the (II) solution are mixed, and a portion of a reducing agent such as hydrazine is added under stirring to the resulting mixture to turn it to a gelling suspension. Another portion of the reducing agent is then added to the gelling suspension under vigorous stirring to return the gelling suspension to a simple suspension. Thus, the coating of the copper powder with a metallic gold layer is completed. The so obtained gold coating layer consists of pure gold metal with substantially no contamination with copper.

This invention further provides another process for the preparation of precious metal-coated particles which comprises mixing:

(A) an aqueous gelling mixture comprising, in the aqueous phase, the precious metal ion and chelated precious metal compound and, in a suspended particle phase, chelated precious metal compound;

(B) hydrogen peroxide in an amount enough to reduce whole of the precious metal ion and the chelated precious metal compound present in both of the aqueous phase and the suspended particle phase to convert to the metallic form;

(C) an aqueous suspension of core material particles in an aqueous medium having little dissolving capacity for the core material; and (D) an alkali agent, to break the gelling state of the (A) gelling mixture, and recovering the produced precious metal-coated particles.

The above-described process is referred to hereinafter as "precious metal chelation process" or simply "chelation process". The characteristic feature of the precious metal chelation process lies in that the portion of the precious metal to form the coating layer is subjected to the reduction to form the coating layer, in the chelated form and also that the reduction is accomplished in a gelling suspension.

Examples of the precious metals (precious metal salts) are the same as those described for the precious metal suspension process.

The aqueous gelling solution containing precious metal ion and chelated precious metal compound referred to as (A) in the above can be prepared, for instance, as follows.

A water-soluble precious metal salt such as silver nitrate is dissolved in water to prepare an aqueous precious metal ion solution of a relatively high concentration such as 5-50% by weight. Separately, a chelating agent such as EDTA (ethylenediaminetetraacetic acid) in the sodium salt form is dissolved in water to prepare a solution containing the chelating agent at a concentration of at least 2% by weight. The so prepared aqueous precious metal ion solution and chelating agent solution are then mixed, resulting in the formation of an aqueous gelling mixture comprising, in the aqueous phase, the precious metal ion and chelated precious metal compound and, in a suspended particle phase, chelated metal compound. In the formation of the above mixture, the chelating agent preferably is incorporated in an amount of less than the stoichiometric amount for the counterpart metal ion to be incorporated in the mixture. More preferably, the chelating agent is in an amount of less than a half of the stoichiometric amount for the incorporated metal ion which serves as the counterpart in the formation of a chelated compound. Addition of greater amount of the chelating agent may inadvantageously causes contamination of the precious metal coating layer upon the reaction to reduce the quality of the coating layer.

Examples of the chelating agents to be employed in the chelating process include polyaminocarboxylic acids such as EDTA, oxycarboxylic acids such as citric acid, and condensed phosphates. Particularly preferred is EDTA.

In the chelation process, hydrogen peroxide serves as a reducing agent in an alkaline solution to reduce the ionic and chelated precious metal to convert to the metallic form. For obtaining a satisfactory precious metal coating layer, hydrogen peroxide is preferably employed in an excessive amount.

The aqueous suspension of core material particles referred to as (C) in the above preferably comprises the core material particles in a ratio ranging from 1/1000 to 1/10 (ratio by weight) per the amount of water.

The core materials can be selected from those described for the precious metal suspension process. In addition to those, the chelation process can employ glass and ceramics. The chelation process is advantageously applied to core materials selected from nickel, and metal oxides such as zirconium oxide and titanium dioxide. As for the size and the ratio of the core material and the precious metal, reference is made to the description given hereinbefore for the precious metal suspension process.

The alkali agent assists hydrogen peroxide to work as a reducing agent. Examples of the alkali agents to be employed in the chelation process include alkali metal hydroxides such as sodium hydroxide and potassium hydroxide. The alkali agent is generally employed as an aqueous solution.

In practicing the chelation process, the four (A), (B), (C) and (D) agents can be mixed in any sequence or simultaneously. Nevertheless, the sequences described below are advantageously adopted for the preparation of a precious metal coating layer of high quality.

Sequence I: Hydrogen peroxide is added to the (A) gelling mixture; then the (C) suspension and finally the alkali agent are added successively thereto. The gelling mixture turns into a simple suspension containing precious metal-coated particles upon the addition of the alkali agent. This sequence is advantageously applied when material having some solubility in an aqueous alkaline solution such as titanium dioxide ($TiO_2$) is employed as the core material.

Sequence II: Hydrogen peroxide is added to the (A) gelling mixture; separately, a portion (e.g., a half) of the alkali agent is added to the (C) suspension; the latter (C+alkali agent) is added to the former (A+hydrogen peroxide); this procedure gives precipitation of a portion of the precious metal of metallic form on the core particle; and finally the remaining portion of the alkali agent is added thereto to break the gelling state to form a simple suspension containing precious metal-coated particles. Alternatively, the whole portion of the alkali agent can be added to the (C) suspension in the initial stage instead of the divisional addition. In this case, the addition of the mixture of (C) suspension and the alkali agent to the mixture of (A) gelling mixture and hydrogen peroxide instantly breaks the gelling state of the latter mixture to form a simple suspension containing precious metal-coated particles.

Sequence II including the alternative sequence is advantageously applied when material having substantially no solubility in an aqueous alkaline solution such as nickel or zirconium oxide is employed as the core material.

As is described hereinbefore, the process of the invention employs a reaction system in which the core material is scarcely dissolved in the reaction medium, and therefore the precious metal coating layer of the precious metal-coated particles obtained according to the invention has substantially no contamination with the core material. For this reason, the precious metal-coated particles provided by the invention is particularly advantageous when these are employed as electroconductive materials for the use in electric circuit, such as electric contactor and electroconductive paste because these show substantially same electroconductivity and adhesion to soft solder as pure metal materials show.

The present invention will be illustrated more in detail by the following examples.

EXAMPLE 1

Preparation of Silver-coated Copper Particles

In an aqueous hydrazine solution was immersed 3 g. of a commercially supplied copper powder to remove the oxide film over the copper powder. The greater portion of the hydrazine solution was then removed through decantation, remaining a small amount of the solution enough for enclosing the copper powder with the solution to keep the powder from oxidation. To this solution was added 400 ml. of conc. hydrochloric acid, and the mixture was then stirred to prepare a suspension [(Ia) suspension] in which the copper powder was uniformly suspended.

Separately, 50 ml. of aqueous solution containing 10 g. of silver nitrate (approximately 6 g. as the silver) was added to 200 ml. of conc. hydrochloric acid, and the mixture was stirred. Thus, a suspension in which the introduced silver nitrate was converted into silver hydrochloride, some portion being dissolved in the liquid phase in the ionic form and the remaining portion being present in the form of powdery crystals was prepared . . . [(IIa) suspension].

To the (Ia) suspension was added a portion (approximately 50 ml.) of the (IIa), suspension and the mixture was stirred. Upon confirmation of deposition of metallic silver over the copper powder surface and of blackening of the metallic silver layer, the remaining portion of the (IIa) suspension was introduced into the mixture. To the so obtained suspension was added 50 ml. of hydrazine (80% solution of hydrazine hydrate, same hereinafter), and the mixture was stirred to become a gelling mixture. The gelling mixture was further stirred vigorously to suspend the copper powder uniformly in the mixture, and 150 ml. of hydrazine was added to the stirred gelling mixture to break the gelling state and simultaneously to precipitate particles coated with metallic silver. The silver-coated particles were collected through filtration. The particles contained silver and copper in the ratio by weight of approximately 2:1.

EXAMPLE 2

Preparation of Gold-coated Copper Particles

The procedure described in Example 1 was repeated, using 3 g. of the copper powder, 250 ml. of conc. hydrochloric acid and 200 ml. of water, to prepare a copper-containing suspension . . . [(Ib) suspension].

Separately, 10.8 g. of $HAuCl_4$ (approximately 6.26 g. as gold) was added to 250 ml. of conc hydrochloric acid, and the mixture was stirred to prepare a solution in which the added bold salt was completely dissolved . . . [(IIb) solution].

The (IIb) suspension was added to the (Ib) solution by two times addition procedure in the same manner as in Example 1 to prepare a suspension. To the so prepared suspension was added 80 ml. of hydrazine, forming a gelling mixture. Further, 160 ml. of hydrazine was added to the gelling mixture, and the resulting mixture was vigorously stirred to break the gelling state into a simple suspension in which particles coated with metallic gold were suspended. The gold-coated particles were collected through filtration, and showed a gold:copper ratio by weight of approximately 2.1:1.

EXAMPLE 3

Preparation of Silver-coated Titanium Dioxide Particles

A gelling solution was produced by mixing an aqueous solution of 10 g. of silver nitrate in 50 ml. of water and an aqueous solution of 15 g. of disodium ethylenediaminetetraacetate (EDTA) in 200 ml. of water. 50 ml. of water was added to the gelling solution to reduce the viscosity of the solution. To the gelling solution was added 100 ml. of aqueous hydrogen peroxide (30% aqueous solution). To this gelling solution was further added a suspension of 1 g. of titanium dioxide powder (mean diameter: 2μ) in 150 ml. of water, and the mixture was well stirred. To this gelling suspension was added under vigorous stirring 100 ml. of aqueous sodium hydroxide (NaOH 5 g./25 ml. water), to break the gelling state quickly and simultaneously to precipitate particles of the titanium dioxide coated with silver. Further, 150 ml. of aqueous hydrogen peroxide (30%) was added to the suspension to complete the reaction.

The so produced silver-coated particles were collected by filtration, washed with water and dried to give gray-colored particles. Yield 6.8 g. (theoretical yield 7.0 g.)

EXAMPLE 4

Preparation of Silver-coated Nickel Particles

A gelling solution was produced by mixing an aqueous solution of 10 g. of silver nitrate in 50 ml. of water and an aqueous solution of 15 g. of disodium salt of EDTA in 300 ml. of water. 150 ml. of water was added to the gelling solution to reduce the viscosity of the solution. To the gelling solution was added 150 ml. of aqueous hydrogen peroxide (30%). To this gelling solution was further added a suspension of 1.5 g. of powdery nickel metal (mean diameter: 3μ) in 50 ml. of aqueous sodium hydroxide (NaOH 5 g./25 ml. water, same hereinbelow), and the mixture was well stirred. At this stage, there was observed no noticeable change in the mixture, except that the hydrogen peroxide began to decompose slowly and that a small amount of silver was deposited on the metallic nickel powder. To this mixture was further added under stirring 50 ml. of aqueous sodium hydroxide to break the gelling state quickly and simultaneously to precipitate particles of the nickel particles coated with silver. The so produced silver-coated particles were recovered in the same manner as in Example 3 to give gray-colored particles. Yield 7.4 g. (theoretical yield 7.5 g.)

EXAMPLE 5

Preparation of Silver-coated Zirconium Oxide Particles

In this example, $ZrO_2$ was pre-treated in the following manner to give the silver coating layer of an improved quality.

To 200 ml. of water were added 10 g. of powdery $ZrO_2$ (mean diameter: 1.5μ), 1 g. of silver nitrate and 1 ml. of a mixture of surface active agents (anionic and nonionic surface active agents), and the so produced mixture was stirred. To this stirred mixture was then added 5 ml. of aqueous hydrazine monohydrate solution (80%). The stirring was continued to reduce the silver ion to precipitate the metallic form over the surface of the $ZrO_2$ particles. The so produced silver-coated particles were collected by filtration, washed with water, dried and then fired at 450° C., for 30 min. in airy atmosphere. There was obtained a substantially theoretical amount of $ZrO_2$ particles coated preliminarily with silver (silver 6 g./100 g. $ZrO_2$).

To 100 ml. of aqueous sodium hydroxide (NaOH 5 g./25 ml. water) was added 1 g. of the above silver-coated $ZrO_2$ particles to give a uniform suspension.

Separately, a gelling mixture was prepared by mixing an aqueous solution of 10 g. of silver nitrate in 50 ml. of water and an aqueous solution of 15 g. of disodium salt of EDTA in 200 ml. of water under stirring, and further adding 50 ml. of water to the mixture. To the so prepared gelling mixture was added 100 ml. of aqueous hydrogen peroxide (30%), and subsequently the $ZrO_2$-containing suspension was added thereto under stirring. The gelling state was quickly broken to precipitate gray-colored particles coated with silver. The precipitated particles were recovered in the same manner as in Example 3. Yield 7.4 g. (theoretical yield 7.5 g.)

EXAMPLE 6

Preparation of Gold-coated Copper Particles

A gelling solution was produced by mixing an aqueous solution of 11 g. of $HAuCl_4$ in 75 ml. of water and an aqueous solution of 25 g. of disodium salt of EDTA in 300 ml. of water. Water was added to this gelling solution to adjust the volume of the solution to 400 ml. To this gelling solution was added 150 ml. of aqueous hydrogen peroxide (30%).

Separately, a commercially supplied powdery copper (mean diameter: 5μ) was immersed in an aqueous hydrazine solution for 1 hour under stirring to remove the oxide film produced on the surface of the powder, and washed with water. 2 g. of the so prepared powdery copper was introduced into 140 ml. of aqueous sodium hydroxide (NaOH 5 g./25 ml. water) to obtain a homogeneous suspension. The above-prepared gelling solution was added to the suspension under stirring. The gelling state was quickly broken to precipitate copper particles coated with gold. The so precipitated particles were then recovered in the same manner as described in Example 3 to give brown-colored particles. Yield 8.2 g. (theoretical yield 8.37 g.)

EXAMPLE 7

Application to Electroconductive Paste

Silver-coated copper particles prepared in Example 1: 10 g.
Lead borosilicate glass frit: 0.2 g.
Ethyl cellulose: 1.0 g.
Ethylcellosolve: 2.5 g.
Terpineol: 2.5 g.

A mixture consisting of the above-listed materials was kneaded in a three-rollers type kneader to give a paste.

The paste was printed on a ceramic base plate through the screen printing method. The so printed ceramic base plate was dried at 150° C. for 30 min., and then placed in a firing furnace. The internal temperature of the furnace was elevated to 800° C. over 1 hour, and this 800° C. temperature was maintained for 10 min. The printed plate was then taken out of the furnace and cooled to room temperature.

The so produced printed plate showed silver metallic surface at the printed portion. The Scanning Electron Microscope (JSM-25S) manufactured by Japan Electron Optics Laboratory Co., Ltd. was applied to the surface of the metallic surface layer of the metallic portion to observe its electron reflection image. The observation indicated that the metallic surface substantially consisted of pure silver metal with no trace of copper metal.

The printed plate was immersed in a soft solder bath, and there was observed that whole surface of the metallic printed area was completely covered with the soft solder. The X-ray Microanalyzer (EMX-SM) manufactured by Shimazu Seisakusho, Ltd., Japan, was applied to the section of the printed metal layer covered with the soft solder. The observation indicated that the joining face between the soft solder portion and the printed metal portion was perfectly produced and that microgranular copper particiles were uniformly dispersed within the silver metal layer. The electroconductivity was almost equivalent to pure silver, $2\times10^{-6}$ Ω cm.

The above-described observations indicate that there is substantially no contamination with copper metal in the silver metal coating layer. This means that the coverage of silver over the copper particles is perfect for the practical employment as the electroconductive paste.

EXAMPLE 8

Application to Electroconductive Paste

The procedures of Example 7 were repeated except that the silver-coated copper particles were replaced with the gold-coated copper particles produced in Example 2 and also except that the amount of lead borosilicate glass frit was changed into 0.4 g. instead of the 0.2 g. to produce a metal printed plate.

The observations were carried out by means of the Scanning Electron Microscope (JSM-25S mentioned as above) in the same manner as in Example 7 to indicate that the metallic surface substantially consisted of pure gold metal with no trace of copper metal.

The printed plate was placed on a hot plate kept at 450° C., and a silicone tip was placed on the printed metal surface. The so placed silicone tip was well adhered to the metal surface.

The observations described above indicate that there was substantially no contamination with copper metal in the gold metal coating layer. Accordingly, the coverage of gold over the copper particles was perfect for the practical employment as the electroconductive paste.

EXAMPLE 9

Application to Electroconductive Paste

The procedures of Example 7 were repeated except that the silver-coated copper particles were replaced with the silver-coated titanium dioxide particles produced in Example 3.

The observations on the surface and the surface layer of the printed metal portion were carried out in the same manner as in Example 7 to give the same results. The electroconductivity of the above paste was almost equivalent to the pure silver paste. Thus, the silver surface was formed on the particle with substantially no contamination with titanium dioxide.

EXAMPLE 10

Application to Electroconductive Paste

The procedures of Example 7 were repeated except that the silver-coated copper particles were replaced with the silver-coated nickel particles produced in Example 4.

The observations on the surface and the surface layer of the printed metal portion and the measurement of electroconductivity were carried out in the same manner as in Example 7 to give the same results. Thus, the silver surface was formed on the particle with substantially no contamination with nickel.

EXAMPLE 11

Application to Electroconductive Paste

The procedures of Example 7 were repeated except that the silver-coated copper particles were replaced with the silver-coated zirconium oxide particles produced in Example 5.

The observations on the surface and the surface layer of the printed metal portion and the measurement of electroconductivity were carried out in the same manner as in Example 7 to give the same results. Thus, the silver surface was formed on the particle with substantially no contamination with zirconium oxide.

EXAMPLE 12

Application to Electroconductive Paste

The procedures of Example 8 were repeated except that the gold-coated copper particles were replaced with the gold-coated copper particles produced in Example 6.

The observations on the surface and the surface layer of the printed metal portion were carried out in the same manner as in Example 8 to give the same results. The adhesion of silicone tip to the gold metal surface was also observed in the same manner to give satisfactory result.

Thus, the gold surface was formed on the particle with substantially no contamination with copper metal.

I claim:

1. A process for the preparation of precious metal-coated particles which comprises adding a non-metallic reducing agent to an aqueous suspension containing (A) homogeneously suspended core material particles having a mean diameter of less than 10μ; (B) homogeneously suspended precious metal salts particles; and (C) dissolved precious metal ions, in which the ratio of the amount of the core material against the total amount of the precious metal contained in both forms in the suspension ranges from 1/9 to 7/3, in an aqueous acidic medium having little dissolving capacity for the core material, so as to produce precious metal-coated particles through formation of gelling state which breaks as the coating proceeds, and recovering the so-produced precious metal-coated particles.

2. A process for the preparation of precious metal-coated particles as claimed in claim 1, in which the precious metal is gold or silver.

3. A process for the preparation of precious metal-coated particles as claimed in claim 1, in which the reducing agent is hydrazine.

4. A process for the preparation of precious metal-coated particles as claimed in claim 1, in which the ratio of the amount of the core material against the total amount of the precious metal contained in both forms in the suspension ranges from 1/9 to 4/6.

5. A process for the preparation of precious metal-coated particles which comprises mixing:

(A) an aqueous gelling mixture comprising, in the aqueous phase, the precious metal ion and chelated precious metal compound and, in a suspended particle phase, chelated precious metal compound;

(B) hydrogen peroxide in an amount enough to reduce the whole of the precious metal ion and the chelated precious metal compound present in both of the aqueous phase and the suspended particle phase to convert to the metallic form;

(C) an aqueous suspension of core material particles having a mean diameter of less than 10μ, in aqueous medium having little dissolving capacity for the core material, in which the ratio of the amount of the core material against the total amount of the precious metal contained in both forms in said aqueous gelling mixture (A) ranges from 1/9 to 7/3; and (D) an alkali agent, so as to break the gelling state of the (A) gelling mixture as the coating proceeds, resulting in formation of precious metal-coated particles, and recovering the so-produced precious metal coated particles.

6. A process for the preparation of precious metal-coated particles as claimed in claim 5, in which the mixing is carried out in the sequence of:

addition of the hydrogen peroxide to the aqueous gelling mixture;

addition of the aqueous suspension of the core material particles to the produced mixture; and then addition of the alkali agent to the produced mixture.

7. A process for the preparation of precious metal-coated particles as claimed in claim 5, in which the mixing is carried out by:

mixing the aqueous gelling mixture with the hydrogen peroxide to obtain another aqueous gelling mixture;

and separately mixing the aqueous suspension of the core material particles with the alkali agent to obtain an aqueous alkaline suspension, and then mixing the obtained aqueous gelling mixture with the obtained aqueous alkaline suspension, and adding an additional amount of the alkali agent, if necessary.

8. A process for the preparation of precious metal-coated particles as claimed in claim 5, in which the ratio of the amount of the core material against the total amount of the precious metal contained in the reaction system ranges from 1/9 to 4/6.

* * * * *